US009500344B2

(12) United States Patent
Baright

(10) Patent No.: US 9,500,344 B2
(45) Date of Patent: Nov. 22, 2016

(54) LIGHTING DEVICE AND HOUSING THEREFOR

(71) Applicant: G&G LED, Red Hook, NY (US)

(72) Inventor: Jason Baright, Red Hook, NY (US)

(73) Assignee: G&G LED, Albany, NY (US)

( * ) Notice: Subject to any disclaimer, the term of this patent is extended or adjusted under 35 U.S.C. 154(b) by 98 days.

(21) Appl. No.: 14/222,572

(22) Filed: Mar. 21, 2014

(65) Prior Publication Data

US 2015/0267899 A1 Sep. 24, 2015

(51) Int. Cl.

| | |
|---|---|
| ***F21V 7/20*** | (2006.01) |
| ***F21V 15/01*** | (2006.01) |
| ***F21V 31/00*** | (2006.01) |
| ***F21V 29/85*** | (2015.01) |
| ***F21V 15/015*** | (2006.01) |
| ***F21V 19/00*** | (2006.01) |
| *F21Y 103/00* | (2016.01) |

(52) U.S. Cl.

CPC ..... *F21V 15/01* (2013.01); *F21S 4/28* (2016.01); *F21V 15/015* (2013.01); *F21V 19/004* (2013.01); *F21V 19/0045* (2013.01); *F21V 29/85* (2015.01); *F21V 31/00* (2013.01); *F21Y 2103/003* (2013.01)

(58) Field of Classification Search

CPC ..... F21K 9/00; F21K 9/17; F21K 9/90; F21V 19/0045; F21V 29/004

See application file for complete search history.

(56) References Cited

U.S. PATENT DOCUMENTS

| | | | | |
|---|---|---|---|---|
| 7,611,260 | B1 | 11/2009 | Lin et al. | |
| 7,815,338 | B2 | 10/2010 | Siemiet et al. | |
| 7,997,770 | B1 | 8/2011 | Meurer | |
| 8,011,805 | B2 | 9/2011 | Chiang | |
| 8,147,091 | B2 | 4/2012 | Hsia et al. | |
| 8,235,545 | B2 | 8/2012 | Zheng et al. | |
| 8,251,544 | B2 | 8/2012 | Ivey et al. | |
| 8,330,362 | B2 | 12/2012 | Lin | |
| 8,388,172 | B2 | 3/2013 | Yue et al. | |
| 8,398,260 | B2 | 3/2013 | Fan | |
| 8,444,292 | B2 | 5/2013 | Ivey et al. | |
| 8,567,986 | B2 | 10/2013 | Szprengiel et al. | |
| 8,653,984 | B2 | 2/2014 | Ivey et al. | |
| 2010/0033964 | A1 | 2/2010 | Choi et al. | |
| 2010/0321921 | A1* | 12/2010 | Ivey | F21K 9/56 362/84 |
| 2011/0176298 | A1* | 7/2011 | Meurer | F21K 9/00 362/218 |
| 2012/0051039 | A1* | 3/2012 | Chang | F21K 9/17 362/218 |
| 2012/0212950 | A1* | 8/2012 | Wei | F21K 9/17 362/218 |
| 2012/0275154 | A1* | 11/2012 | Hood | F21V 31/005 362/249.02 |
| 2012/0300446 | A1* | 11/2012 | Kim | F21K 9/17 362/218 |
| 2013/0050999 | A1 | 2/2013 | Simon | |

* cited by examiner

*Primary Examiner* — Andrew Coughlin
(74) *Attorney, Agent, or Firm* — Hoffman Warnick LLC

(57) ABSTRACT

Embodiments of the invention relate generally to lighting devices and, more particularly, to lighting devices having tubular housings containing light emitting devices on a circuit board, as well as housings for such lighting devices. In one embodiment, the invention provides a lighting device comprising: a circuit board including a light emitting device; and an elongate substantially tubular housing for enclosing the circuit board, the tubular housing including: a substantially circular interior; a support shelf extending across the substantially circular interior to support the circuit board; and a circuit board restraining member restraining the circuit board to the support shelf.

20 Claims, 7 Drawing Sheets

LIGHTING DEVICE AND HOUSING THEREFOR

BACKGROUND OF THE INVENTION

Embodiments of the invention relate generally to lighting devices and, more particularly, to lighting devices having tubular housings containing light emitting devices on a circuit board, as well as housings for such lighting devices.

BRIEF DESCRIPTION OF THE INVENTION

In one embodiment, the invention provides a lighting device comprising: a circuit board including a light emitting device; and an elongate substantially tubular housing for enclosing the circuit board, the tubular housing including: a substantially circular interior; a support shelf extending across the substantially circular interior to support the circuit board; and a circuit board restraining member restraining the circuit board to the support shelf.

In another embodiment, the invention provides a lighting device comprising: a circuit board including a light emitting device; and an elongate substantially tubular housing for enclosing the circuit board, the tubular housing including: a substantially circular interior; a first support member extending inward from the substantially circular interior to support the circuit board; a second support member extending inward from the substantially circular interior to support the circuit board, the second support member being positioned substantially opposite the first support member; and at least one circuit board restraining member restraining the circuit board against at least one of the first and second support members.

In still another embodiment, the invention provides an elongate tubular housing for enclosing a lighting device, the elongate tubular housing including: a substantially circular interior; a support shelf extending across the substantially circular interior to support a lighting device circuit board; and a circuit board restraining member restraining a circuit board against the support shelf.

In yet another embodiment, the invention provides an elongate tubular housing for enclosing a lighting device, the elongate tubular housing including: a substantially circular interior; a first support member extending inward from the substantially circular interior to support the circuit board; a second support member extending inward from the substantially circular interior to support the circuit board, the second support member being positioned substantially opposite the first support member; and at least one circuit board restraining member restraining a circuit board against at least one of the first and second support members.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figures 1, 2:
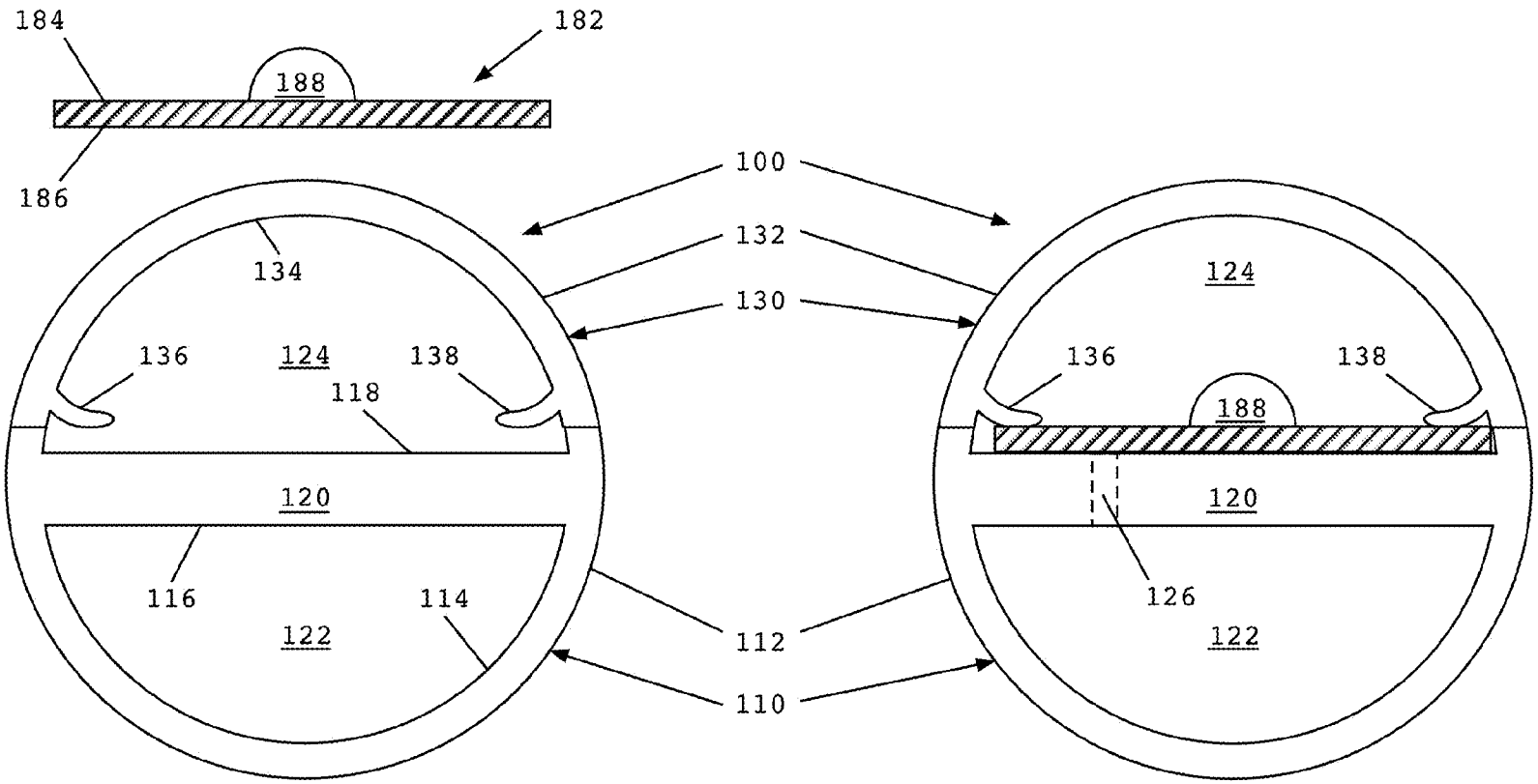
FIGS. 1-13 show cross-sectional views of lighting devices and lighting device housings according to various embodiments of the invention.

Turning now to the drawings, FIG. 1 shows a cross-sectional view of a housing 100 and circuit board 182 including a light emitting device 188. Circuit board 182 includes an upper surface 184, to which light emitting device 188 is affixed, and a lower surface 186. Methods and techniques for physically and electrically connecting light emitting device 188 to circuit board 182 are known in the art and will not be described in detail here for the sake of brevity. As will be recognized by one skilled in the art, circuit board 182 may include associated circuitry, such as driver circuitry.

In some embodiments of the invention, light emitting device 188 is a light emitting diode (LED). In other embodiments, light emitting device 188 may comprise an incandescent or fluorescent lighting device. Together, a housing and a circuit board including a light emitting device comprise a lighting device according to an embodiment of the invention.

Housing 100 is substantially circular in cross-sectional shape, having a first portion 110 and a second portion 130. Each of first portion 110 and second portion 130 includes a substantially circular outer surface 112, 132 and a substantially circular inner surface 114, 134. First portion 110 may comprise a polycarbonate, such as, for example, the thermoplastic polycarbonate LEXAN 153 resin (SABIC Innovative Plastics) or the polycarbonate/ABS material CYCOLOY (SABIC Innovative Plastics). In such embodiments, the thermoplastic polycarbonate may be opaque.

In some embodiments of the invention, the material of first portion 110 is thermally-conductive. In such embodiments, first portion 110 may act to absorb and then dissipate heat generated by light emitting device 188, circuit board 182, and/or their associated circuitry. Such heat-dissipating properties may be imparted by the material of first portion 110 itself or, according to some embodiments of the invention, by a separate thermally-conductive material, such as aluminum, copper, steel, or alloys thereof, embedded within the material of first portion 110.

Second portion 130 preferably comprises a transparent or translucent material, such as a polycarbonate, an acrylic, or a glass. In some embodiments of the invention, the material of second portion 130 comprises LEXAN resin SLX2531T (SABIC Innovative Plastics). The material of second portion 130 may include, as a coating or integrated material, a UV-resistant material and/or a material capable of diffusing light produced by light emitting device 188.

First portion 110 and second portion 130 are preferably formed simultaneously or substantially simultaneously. For example, first portion 110 and second portion 130 may be co-extruded, such that each is formed at the same time from different materials. Such simultaneous or substantially simultaneous formation permits the manufacture of a seamless joint between first portion 110 and second portion 130 that is impervious to water and atmosphere under typical operating conditions, such as normal atmospheric pressure.

As shown in FIGS. 1 and 2, first portion 110 includes a support shelf 120 extending across the substantially circular inner surface 114. Support shelf 120 divides an interior of housing 100 into a first cavity 122 and a second cavity 124. As shown in FIG. 2, one or more channels 126 may be provided in support shelf 120, thereby connecting first cavity 122 and second cavity 124. Such channels 126 may be useful, for example, where first cavity 122 is used as a conduit raceway, such that connections may be made between electrical wires within first cavity 122 and circuit board 182.

Second portion 130 includes a first restraining member 136 and a second restraining member 138. First and second restraining members 136, 138 act to restrain circuit board 182 against an upper surface 118 of support shelf 120, as shown in FIG. 2. Specifically, as shown in FIGS. 1 and 2, first and second restraining members 136, 138 are a pair of tabs operable to exert a downward force upon upper surface 184 of circuit board 182, securing lower surface 186 of circuit board 182 against upper surface 118 of support shelf 120. The application of a downward force upon circuit board 182 acts to maintain contact between upper surface 118 of support shelf 120 and lower surface 186 of circuit board 182. In embodiment in which the material of first portion 110 is thermally-conductive, this serves to improve the transfer of heat from circuit board 182 to support shelf 120 of first portion 110.

Figure 3:
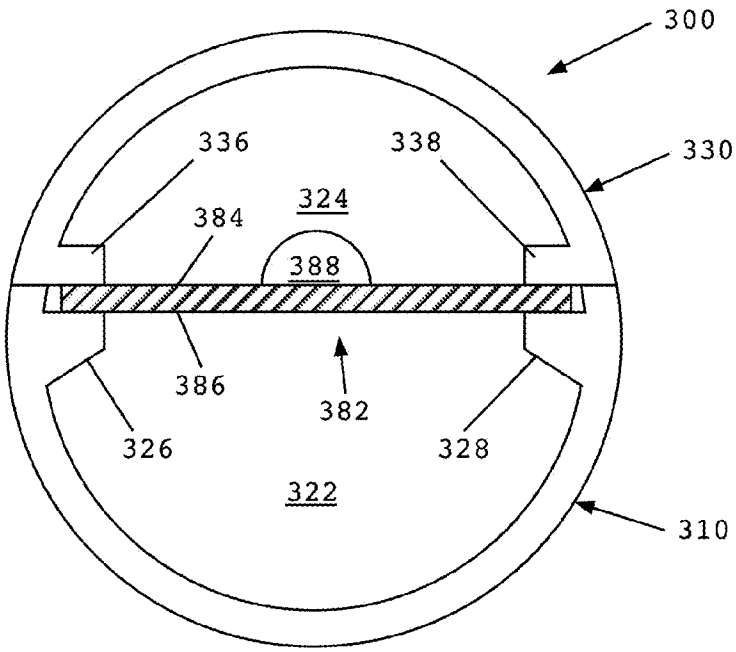

FIG. 3 shows a cross-sectional view of a housing 300 according to another embodiment of the invention. Rather than a support shelf, as in FIGS. 1 and 2, first portion 310 includes a pair of support members 326, 328, which support a portion of a lower surface 386 of circuit board 382. As such, first and second cavities 322, 324 are defined by circuit board 382. In an embodiment such as that shown in FIG. 3, first cavity 322 may be employed as a conduit raceway without the need for channels (126 in FIG. 2) to electrically connect electrical wires within the conduit raceway to circuit board 382.

Figure 4:
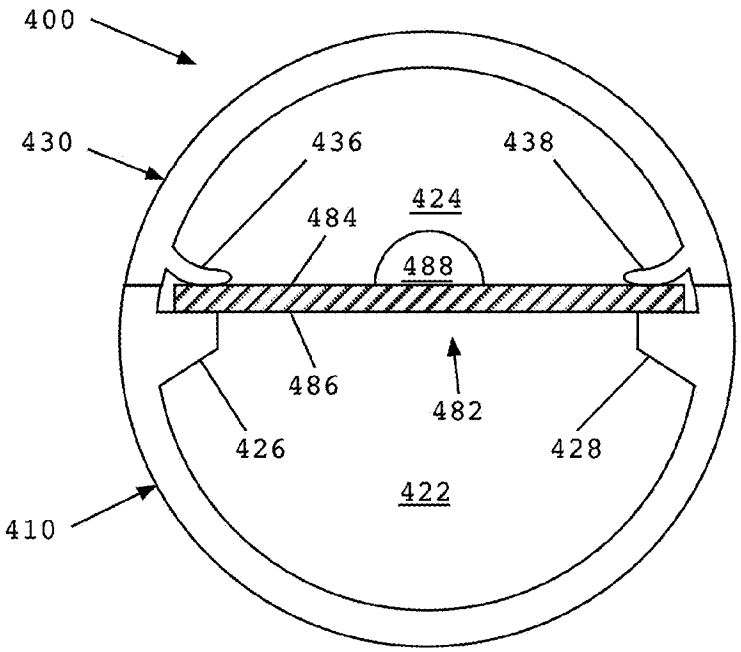
Figure 5:
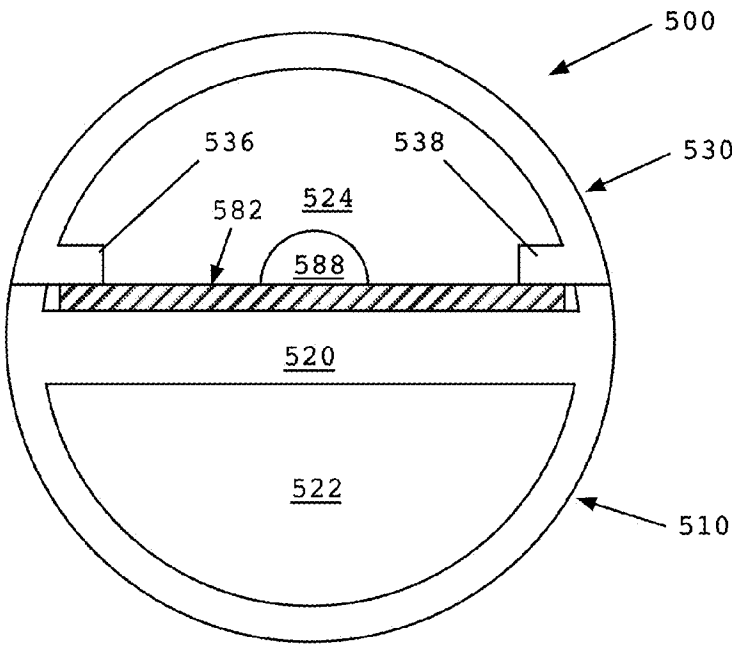

Restraining members 336, 338 of second portion 330 together form a pair of slots or channels in which circuit board 382 may be held. As shown in FIG. 3, restraining members 336, 338 are substantially straight and shaped similar to the pair of support members 326, 328, although other arrangements are possible, of course. For example, FIG. 4 shows a cross-sectional view of a housing 400 according to yet another embodiment of the invention. Here, restraining members 436, 438 are curved in shape, similar to the embodiments shown in FIGS. 1 and 2. FIG. 5 shows a cross-sectional view of a housing 500 according to still another embodiment of the invention. Here, first portion 510 includes a support shelf 520 and restraining members 536, 538 are substantially straight, as shown in FIG. 3.

Figure 6:
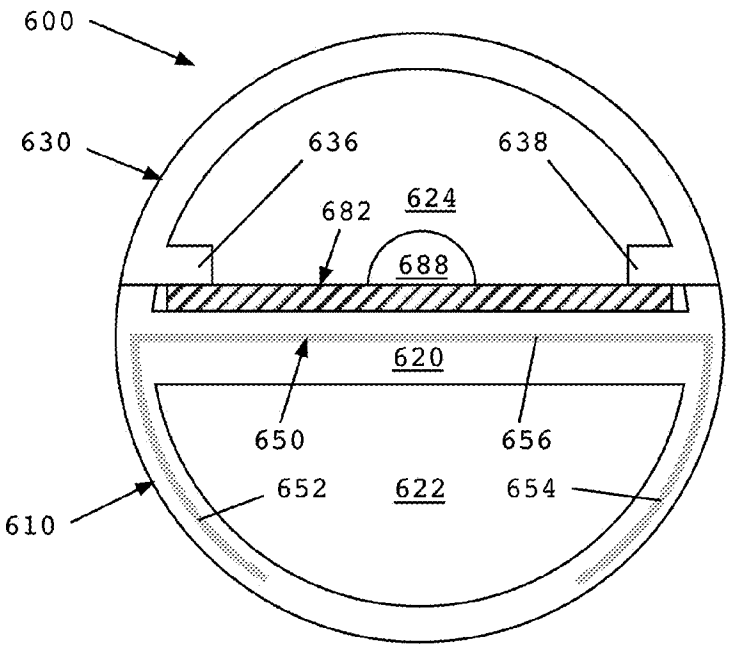

In FIG. 6, a stiffening member 650 has been added to first portion 610. According to some embodiments of the invention, stiffening member 650 is thermally-conductive. For example, stiffening member 650 may comprise or include aluminum, copper, or alloys thereof. As shown in FIG. 6, stiffening member 650 includes a radial portion 656 extending substantially through support shelf 620 and a pair of arcuate portions 652, 654 within first portion 610. In the embodiment of FIG. 6, radial portion 656 also serves to ensure that support shelf 620 remains substantially flat as first portion 610 is formed. For example, where first portion 610 is an extruded polycarbonate, radial portion 656 of stiffening member 650 helps ensure that support shelf 620 does not droop or otherwise deform in such a manner that contact with circuit board 682 cannot be uniformly maintained.

Figure 7:
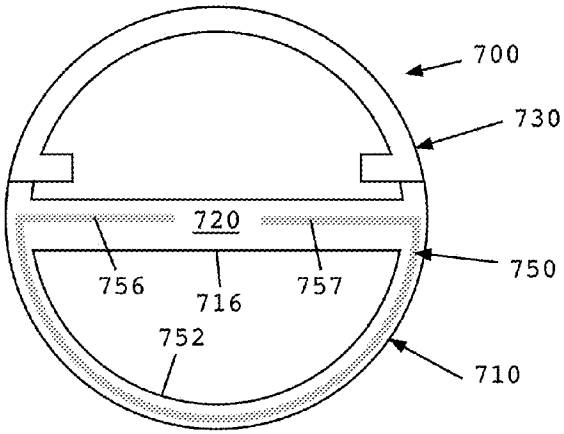

Other arrangements of stiffening members are possible, of course. For example, in FIG. 7, stiffening member 750 includes an arcuate portion 752 extending through substantially all of first portion 710 and a pair of radial portions 756, 757 within support shelf 720.

Figure 8:
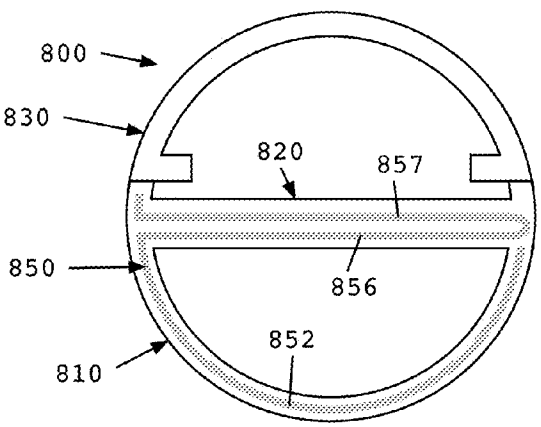
Figure 9:
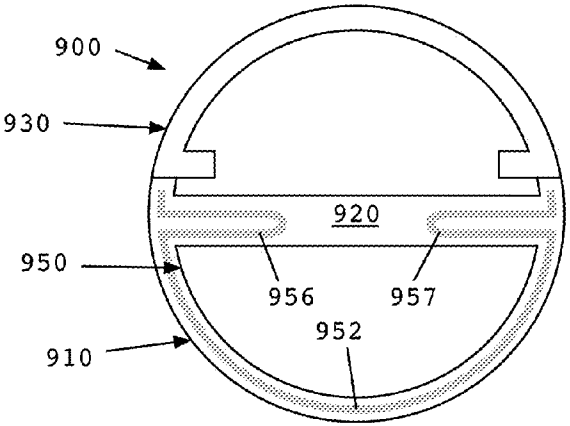

FIGS. 8 and 9 show cross-sectional views of other embodiments of the invention, each with still other arrangements of the stiffening members. In FIG. 8, stiffening member 850 includes an arcuate portion 852 extending substantially through all of first portion 810 and a pair of radial portions 856, 857, each extending through support shelf 820 in a hairpin arrangement. In FIG. 9, stiffening member 950 includes an arcuate portion 952 extending through substantially all of first portion 910 and a pair of radial portions 956, 957, each extending partially into support shelf 920 in hairpin arrangements.

Figure 11:
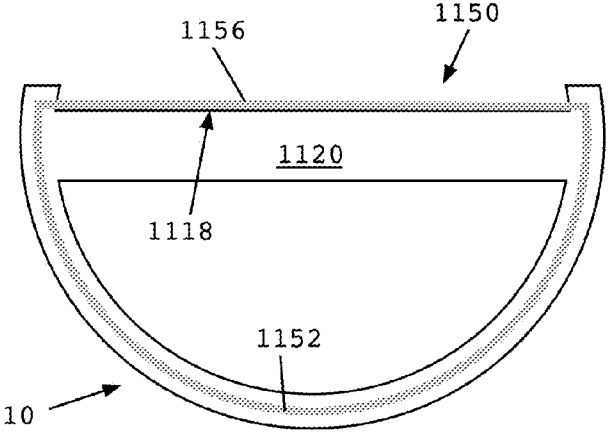
Figure 10:
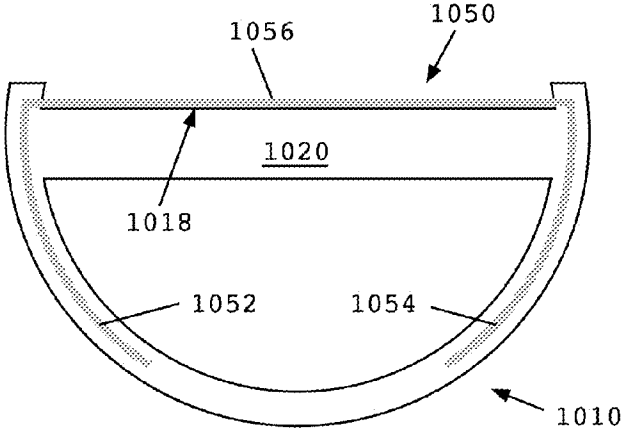
Figure 12:
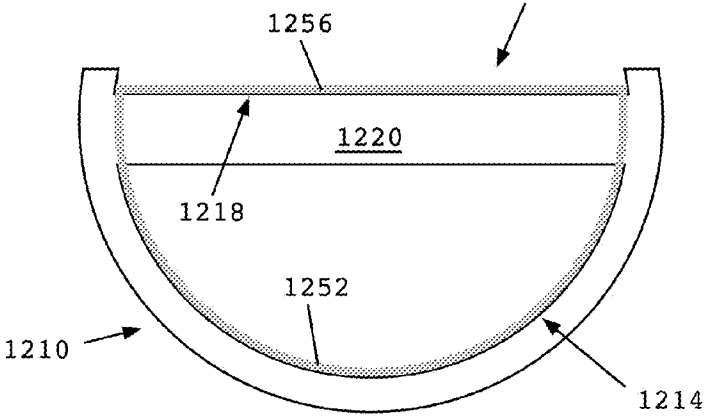

FIGS. 10-12 show first portions 1050, 1150, 1250 of housings according to still other embodiments of the invention. Each shows, respectively, a radial portion 1056, 1156, 1256 of stiffening member 1050, 1150, 1250 disposed along an upper surface 1018, 1118, 1218 of support shelf 1020, 1120, 1220. In FIG. 12, an arcuate portion 1252 of stiffening member 1250 is similarly disposed along inner surface 1214 of first portion 1210.

Figure 13:
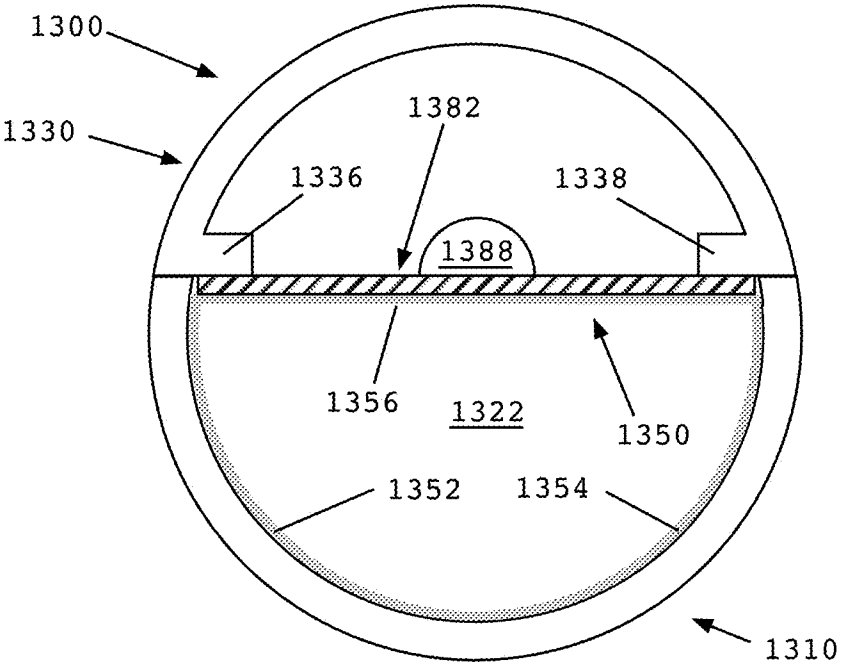

FIG. 13 shows housing 1300 according to another embodiment of the invention. Here, radial portion 1356 of stiffening member 1350 acts directly as a support shelf. In the embodiment shown in FIG. 13, arcuate portions 1352, 1354 of stiffening member 1350 meet and are disposed along an inner surface of first portion 1310, such that first cavity 1322 is lined by stiffening member 1350.

Figure 14:
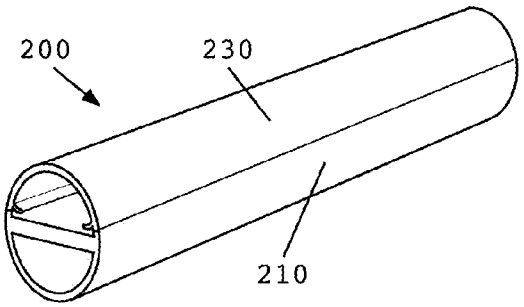
FIGS. 14-15 show perspective views of lighting device housings according to an embodiment of the invention.
Figure 14:
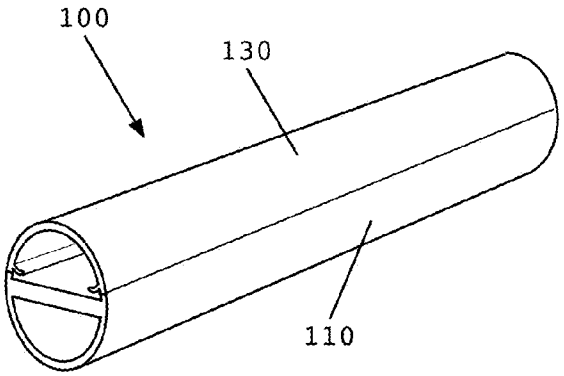
Figure 15:
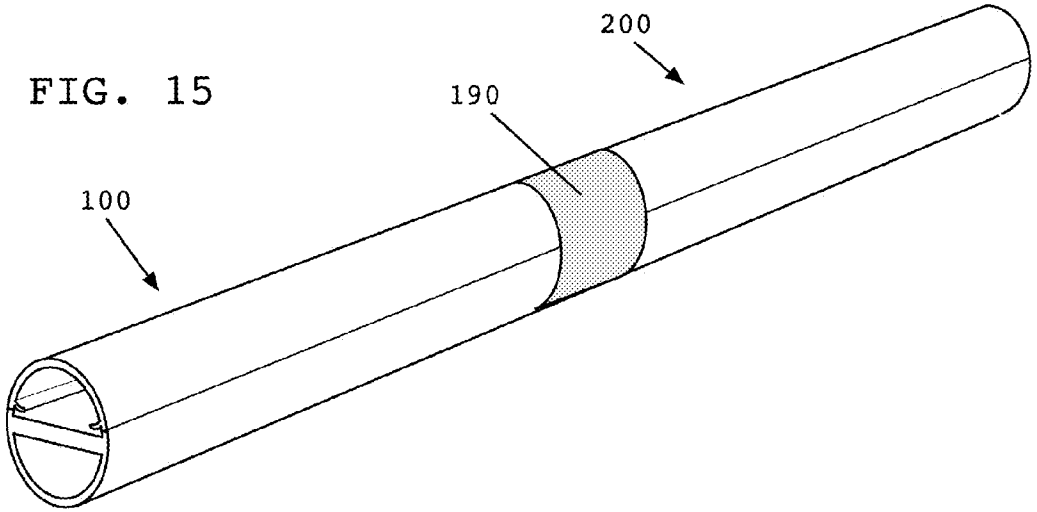

FIG. 14 shows a perspective view of a pair of elongate housings 100, 200 according to an embodiment of the invention. As described above, each housing comprises a first portion 110, 210 and a second portion 130, 230, respectively. As shown above with respect to FIGS. 1 and 2, a circuit board 182 having one or more light emitting devices 188 may be inserted into each housing 100, 200 and electrically connected. Housings 100, 200 may then be physically connected, as shown in FIG. 15, for example, using a tubular joint or fitting 190. Fitting 190 may also enable the electrical connection of housings 100, 200, such that a continuous electrical connection may be established and maintained between circuit boards within each housing 100, 200. In some embodiments of the invention, fitting 190 provides a substantially waterproof seal between housings 100, 200. Similarly, although not shown in FIG. 15, but as would be apparent to one skilled in the art, a similar end cap or boot may be affixed to either or both ends of housings 100, 200 so joined. In some embodiments, fitting 190 or such an end cap or boot may include a conduit or similar device for enclosing an electrical supply wire to the circuit boards within housings 100, 200.

Fitting 190 and/or such an end cap or boot may be formed from any number of materials, both rigid and flexible. Suitable materials include, for example, and without limitation, polyvinyl chloride (PVC), rubber, silicone, neoprene, polycarbonate, and nylon. Other materials may also be employed, depending upon the particular application to which the housing will be put, as will be apparent to one skilled in the art.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A lighting device comprising:

a circuit board including a light emitting device; and an elongate substantially tubular housing for enclosing the circuit board, the housing comprising a first co-extruded portion and a second co-extruded portion and including:

a substantially continuous exterior;

a substantially circular interior;

a support shelf within the first co-extruded portion and extending across the substantially circular interior to support the circuit board; and a circuit board restraining member within the second co-extruded portion and restraining the circuit board to the support shelf.

2. The lighting device of claim 1, wherein the light emitting device includes a light emitting diode (LED).

3. The lighting device of claim 1, wherein the first co-extruded portion includes a thermally-conductive material.

4. The lighting device of claim 3, wherein the thermally-conductive material is selected from a group consisting of: a thermoplastic polycarbonate, aluminum, copper, aluminum alloys, and copper alloys.

5. The lighting device of claim 1, wherein the second co-extruded portion includes a transparent or translucent material.

6. The lighting device of claim 1, further comprising:

a stiffening member embedded within the first co-extruded portion.

7. The lighting device of claim 6, wherein the stiffening member is thermally-conductive.

8. The lighting device of claim 6, wherein the stiffening member is selected from a group consisting of: aluminum, copper, and alloys thereof.

9. The lighting device of claim 6, wherein the stiffening member extends along the support shelf and into opposing sides of the first co-extruded portion.

10. The lighting device of claim 1, wherein the elongate tubular housing includes a plurality of elongate tubular housings coupled at respective ends thereof by a waterproof joint, each housing containing a circuit board.

11. The lighting device of claim 1, wherein the circuit board restraining member comprises a pair of tabs integral with the substantially circular interior for exerting a force against the circuit board in a radial direction but permitting movement of the circuit board in an axial direction, with respect to the elongate, substantially tubular housing.

12. A lighting device comprising:

a circuit board including a light emitting device; and an elongate substantially tubular housing for enclosing the circuit board, the housing comprising a first co-extruded portion and a second co-extruded portion and including:

a substantially continuous exterior;

a substantially circular interior;

a first support member within the first co-extruded portion and extending inward from the substantially circular interior to support the circuit board; and a second support member within the first co-extruded portion and extending inward from the substantially circular interior to support the circuit board, the second support member being positioned substantially opposite the first support member; and at least one circuit board restraining member within the second co-extruded portion and restraining the circuit board against at least one of the first and second support members.

13. The lighting device of claim 12, wherein the light emitting device includes a light emitting diode (LED).

14. The lighting device of claim 12, further comprising:

a stiffening member embedded within the first co-extruded portion.

15. The lighting device of claim 12, wherein the circuit board restraining member comprises a pair of tabs integral with the substantially circular interior for exerting a force against the circuit board in a radial direction but permitting movement of the circuit board in an axial direction, with respect to the elongate, substantially tubular housing.

16. An elongate tubular housing for enclosing a lighting device, the elongate tubular housing comprising a first co-extruded portion and a second co-extruded portion and including:

a substantially continuous exterior;

a substantially circular interior;

a support shelf within the first co-extruded portion and extending across at least a portion of a diameter of the substantially circular interior to support a lighting device circuit board; and a circuit board restraining member within the second co-extruded portion and to restrain a circuit board against the support shelf.

17. The elongate tubular housing of claim 16, wherein the first co-extruded portion of the substantially tubular housing includes a thermally-conductive material selected from a group consisting of: a thermoplastic polycarbonate, aluminum, copper, aluminum alloys, and copper alloys.

18. The elongate tubular housing of claim 16, wherein the second co-extruded portion of the substantially tubular housing includes a transparent or translucent material selected from a group consisting of: a thermoplastic polycarbonate and a glass.

19. The elongate tubular housing of claim 17, further comprising:

a stiffening member embedded within the first co-extruded portion.

20. The elongate tubular housing of claim 16, wherein the circuit board restraining member comprises a pair of tabs integral with the substantially circular interior for exerting a force against the circuit board in a radial direction but permitting movement of the circuit board in an axial direction, with respect to the elongate, substantially tubular housing.

* * * * *